United States Patent [19]

Kwant et al.

[11] 4,200,519

[45] Apr. 29, 1980

[54] PROCESS FOR THE PREPARATION OF GAS OIL

[75] Inventors: Pieter B. Kwant, Amsterdam; Dirk Kanbier, The Hague; Petrus W. H. L. Tjan, Amsterdam; Mohammed Akbar, The Hague, all of Netherlands

[73] Assignee: Shell Oil Company, Houston, Tex.

[21] Appl. No.: 43,195

[22] Filed: May 29, 1979

[30] Foreign Application Priority Data

Jul. 7, 1978 [NL] Netherlands ..... 7807356

[51] Int. Cl.[2] ..... C10G 37/02

[52] U.S. Cl. ..... 208/77; 208/79; 208/80; 208/86; 208/92; 208/94; 208/95; 208/106; 208/107

[58] Field of Search ..... 208/77, 72, 76, 106, 208/107, 80, 79

[56] References Cited

U.S. PATENT DOCUMENTS

| | | | |
|---|---|---|---|
| 2,943,050 | 6/1960 | Beavon | 208/309 |
| 3,053,751 | 9/1962 | Garwin | 208/45 |
| 3,254,020 | 5/1966 | Frayer et al. | 208/89 |
| 4,039,429 | 8/1977 | Klinken et al. | 208/50 |
| 4,062,758 | 12/1977 | Goudriaan et al. | 208/80 |
| 4,120,778 | 10/1978 | Goudriaan et al. | 208/80 |
| 4,126,538 | 11/1978 | Goudriaan et al. | 208/80 |

OTHER PUBLICATIONS

Medlin et al., "Process Feed for more Cat. Gasoline" Petroleum Refiner, May 1958, pp. 167–172.

"Combination Unit," Foster-Wheeler Corp., Petroleum Refiner, Sep. 1958, p. 249.

Shell Int. Research, "Combined Thermal Cracking-Deasphalting Process" Lapis Aug. 1964, p. 26.

"Visbreaking, M. W. Kellogg Co., Hydrocarbon Processing, Sep. 1974, p. 123.

*Primary Examiner*—Delbert E. Gantz
*Assistant Examiner*—G. E. Schmitkons
*Attorney, Agent, or Firm*—Ronald R. Reper

[57] ABSTRACT

A process for the preparation of gas oil from residual oils by combination of two stages of thermal cracking, cyclone separation, vacuum distillation, deasphalting, atmospheric distillation, and recycling of certain streams.

6 Claims, 1 Drawing Figure

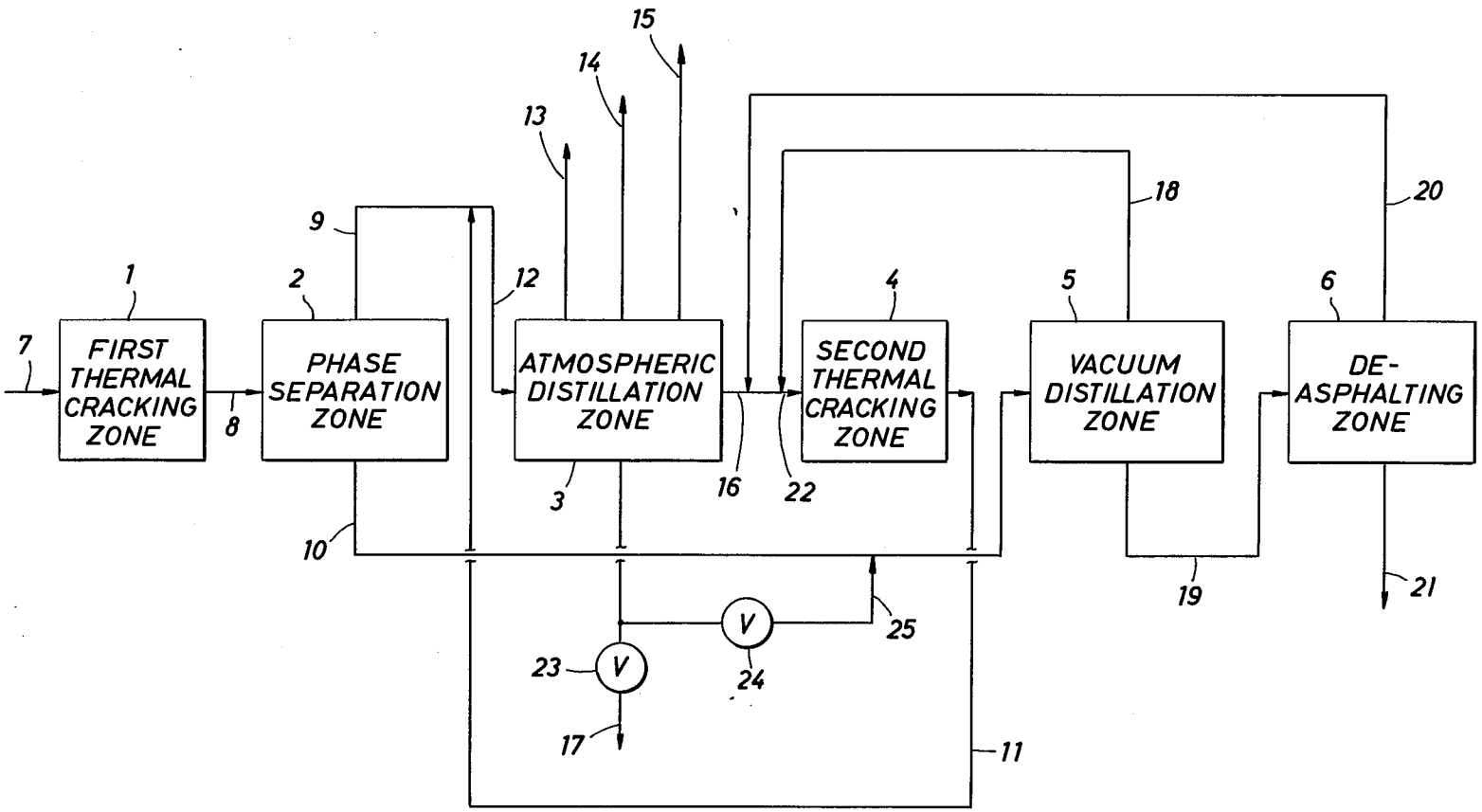
FIRST THERMAL CRACKING ZONE
PHASE SEPARATION ZONE
ATMOSPHERIC DISTILLATION ZONE
SECOND THERMAL CRACKING ZONE
VACUUM DISTILLATION ZONE
DE-ASPHALTING ZONE
V
V
1
2
3
4
5
6
7
8
9
10
11
12
13
14
15
16
17
18
19
20
21
22
23
24
25

PROCESS FOR THE PREPARATION OF GAS OIL

BACKGROUND OF THE INVENTION

The invention relates to a process for the preparation of gas oil from an asphaltenes-containing hydrocarbon oil by thermal cracking.

In the atmospheric distillation of crude mineral oil, as practiced on a large scale in refineries for the preparation of gasolines, kerosines and gas oils, an asphaltenes-containing oil is obtained as a by-product. In view of the increasing need for the above-mentioned hydrocarbon oil distillates and the decreasing reserves of crude mineral oil, several processes have been proposed aiming at the conversion of the asphaltenes-containing oils, which were at first used substantially as fuel oil, into hydrocarbon oil distillates. Examples of such processes are catalytic cracking, thermal cracking, gasification in combination with hydrocarbon synthesis, coking and hydrocracking. Previously, Applicant's employer developed an attractive process for the preparation of gas oil from asphaltenes-containing hydrocarbon oils by thermal cracking. This process is carried out in an apparatus system which comprises the first thermal cracking unit, a cyclone phase separation unit, an atmospheric distillation unit (in which, if desired, the distillation can be carried out at a maximum pressure of 5 bar) and the second thermal cracking unit. In the process the asphaltenes-containing hydrocarbon oil is converted by thermal cracking in the first thermal cracking unit into a cracked product which comprises 5–30%w of components boiling below the boiling range of the feed. The cracked product is separated in the cyclone unit into a light fraction boiling substantially below 500° C. and which contains, in addition to components boiling below 350° C., both light and heavy components boiling between 350° and 500° C., and into a heavy fraction boiling substantially above 350° C. and which contains, in addition to components boiling above 500° C., both light and heavy components boiling between 350° and 500° C. The light fraction from the cyclone unit is mixed with the cracking product from the second thermal cracking unit and the mixture is separated in the atmospheric distillation unit into a number of light distillate fractions of which the heaviest is the desired gas oil, a heavy distillate fraction and a residual fraction. The heavy distillate fraction from the atmospheric distillation unit is converted in the second thermal cracking unit into a cracking product which consists of 20–75%w of components boiling below the boiling range of the feed for the first thermal cracking unit.

Although the above-described process offers the possibility of preparing a high-grade gas oil from an asphaltenes-containing hydrocarbon oil as the starting material, it has the drawback that the yield of atmospheric distillates is low. Now Applicants have carried out an investigation to find measures by which the yield of atmospheric distillates can be increased using the above-described process. In this investigation it was found that the heavy fraction which is separated in the cyclone unit consists to a considerable extent of components which are very suitable for use as the feed for the second thermal cracking unit. These components may partly be isolated from the heavy fraction by subjecting said heavy fraction to vacuum distillation and then by subjecting the vacuum residue obtained in this vacuum distillation to a deasphalting step. The mixture of vacuum distillate and deasphalted oil was found very suitable for use as feed component for the second thermal cracking unit.

SUMMARY OF THE INVENTION

The present invention therefore provides a process for the preparation of gas oil from an asphaltenes-containing hydrocarbon oil, which comprises (a) thermally cracking said asphaltenes-containing oil in a first thermal cracking zone at a temperature from about 400° to 500° C. and a pressure from about 1 to about 30 bar, to obtain a first cracked product comprising 10 to 30 %w on said asphaltenes-containing oil of material boiling at a temperature lower than the boiling range of said asphaltenes-containing oil, (b) separating the product of step (a) by flashing in a phase separation zone into
  (i) a light fraction boiling substantially below 500° C. which contains in addition to components boiling below 350° C., additional components boiling between 350° and 500° C., and
  (ii) a heavy fraction boiling substantially above 350° C. which contains in addition to components boiling above 500° C., additional components boiling between 350° and 500° C., (c) separating the heavy fraction from step (b) by fractionation distillation in a vacuum distillation zone into a vacuum distillate fraction a vacuum residue, (d) deasphalting the vacuum residue from step (c) in a deasphalting zone into a deasphalted oil and bitumen.

(e) separating the light fraction from step (b) by fractionation distillation in an atmospheric distillation zone into at least one light distillate fraction, a heavy distillate fraction and an atmospheric residual fraction, (f) passing the vacuum distillate fraction from step (c) and the deasphalted oil from step (d) to step (g), (g) thermally cracking the heavy distillate fraction from step (e) in admixture with components from step (f) in a second thermal cracking zone at a temperature from about 400° to 550° C. and a pressure from about 1 to 30 bar to obtain a second cracked product comprising from 20 to 75 %w of components boiling below the boiling range of said asphaltenes-containing oil feed to step (a), and (h) withdrawing said at least one light distillate fraction from step (e).

BRIEF DESCRIPTION OF THE DRAWING

The drawing comprises a schematic representation of apparatus suitable for the preparation of gas oils according to the process of this invention.

DESCRIPTION OF PREFERRED EMBODIMENTS

In the process according to the invention the starting material should be an asphaltenes-containing hydrocarbon oil as the feed for the first thermal cracking unit. Examples of suitable asphaltenes-containing hydrocarbon oils are atmospheric residues and vacuum residues obtained in the distillation of crude mineral oil, mixtures of atmospheric residues, mixtures of vacuum residues, mixtures of atmospheric and/or vacuum residues with distillates obtained in the vacuum distillation of atmospheric residues. The asphaltenes-containing hydrocarbon oil that is preferably used is an atmospheric distillation residue of a crude mineral oil.

In the process according to the invention it is preferred to operate the first thermal cracking unit at a temperature between 400° and 500° C. and the second thermal cracking unit at a temperature between 400° and 550° C. Both thermal cracking units are preferably operated at an elevated pressure, such as a pressure between 1 and 30 bar. With respect to the conversion that takes place in the two cracking units it can be observed that preference is given to the use of such cracking conditions in the first and the second thermal cracking unit that cracking products are obtained which consist of 10–30 %w and 20–60 %w, respectively, of components boiling below the boiling range of the feed for the first thermal cracking unit.

With an eye to the gas oil yield it is essential that the deasphalting is applied only to a vacuum residue of the heavy fraction from the cyclone unit and not the entire heavy fraction. In a comparison of the results obtained using two oils A and B as the feed component for the second thermal cracking unit, which oils were equal in metal and asphaltenes contents and the RCR (Ramsbottom Carbon Residue) and which had been prepared from a heavy fraction of the same kind from the cyclone phase separation unit, i.e., oil A by deasphalting the entire heavy fraction and oil B by vacuum distillation of the heavy fraction, deasphalting of the vacuum residue and mixing of the vacuum distillates and the deasphalted oil in production ratio, respectively, it was found that the use of oil B gives a considerably higher gas oil yield.

In the investigation by the Applicants concerning measures for increasing the yield of atmospheric distillates, it has further been found that the residual fraction that is separated in the atmospheric distillation unit, consists also to a considerable extent of components which are suitable for use as the feed for the second thermal cracking unit. These components can be separated from the residual fraction by subjecting the latter to vacuum distillation and by subjecting the vacuum residue obtained in this vacuum distillation to deasphalting. Both the vacuum distillate and the deasphalted oil have been found very suitable for use as the feed for the second thermal cracking unit. The process according to the invention can therefore very conveniently be carried out by using, in addition to a vacuum distillate/deasphalted oil mixture prepared from the heavy faction from the cyclone unit, also a vacuum distillate and/or a deasphalted oil prepared from the residual fraction from the atmospheric distillation unit as the feed component for the second thermal cracking unit. If the aim is to use, in addition to a vacuum distillate/deasphalted oil mixture prepared from the heavy fraction from the cyclone unit, also a vacuum distillate/deasphalted oil mixture prepared from the residual fraction from the atmospheric distillation unit as the feed component for the second thermal cracking unit, the vacuum distillation and ensuing deasphalting can very conveniently be applied to a mixture of the heavy fraction from the cyclone unit and the residual fraction from the atmospheric distillation unit.

The deasphalting to be carried out in the process is preferably effect by using butane as the solvent, in particular at a solvent/oil weight ratio greater than 1.0.

Two process schemes for the preparation of gas oil from an asphaltenes-containing hydocarbon oil according to the invention will be explained in more detail below with reference to the attached drawing.

Process Scheme I (See Drawing)

The process is carried out in an apparatus comprising, successively, the first thermal cracking zone (1), a phase separating zone (2), an atmospheric distillation zone (3), the second thermal cracking zone (4), a vacuum distillation zone (5), and a deasphalting zone (6). An asphaltenes-containing hydrocarbon oil residue (7) obtained by atmospheric distillation is thermally cracked in zone (1), and the cracked product (8) is separated into a light fraction (9) and a heavy fraction (10). The light fraction (9) is mixed with a cracked product (11), and the mixture (12) is separated into a gas stream (13), a gasoline fraction (14), a gas oil fraction (15), a heavy distillate fraction (16), and a residual fraction (17). The heavy fraction (10) is separated into a vacuum distillate (18) and a vacuum residue (19), and the vacuum residue (19) is further separated into a deasphalted oil (20) and bitumen (21). The heavy distillate fraction (16) is mixed with the vacuum distillate (18) and with the deasphalted oil (20), and the mixture (22) is thermally cracked in zone (4). Optionally, atmosphere fraction (17) may be combined with heavy fraction (10) as feed to this vacuum distillate zone (5) by closing, at least partly valve (23), opening at least partly, valve (24) and passing the residue via line 25.

Process Scheme II (See Drawing)

The process is carried out in substantially the same way as described under process scheme I with these differences that in the present case the heavy fraction (10) and the residual fraction (17) are mixed and that the mixture is subjected to vacuum distillation and deasphalting instead of the heavy fraction only (10).

Process Scheme II (See Drawing)

The process is carried out in substantially the same way as described under process scheme I with these differences that in the present case the vacuum distillation unit (5) and the deasphalting unit (6) are omitted and that the feed for the second thermal cracking unit consists only of the heavy distillate fraction (16) instead of the mixture (22).

Process Scheme IV (See Drawing)

The process is carried out in substantially the same way as described under process scheme I with these differences that in the present case the vacuum distillation unit (5) is omitted, that the heavy fraction (10) is separated by deasphalting into a deasphalted oil and bitumen, and that the feed for the second thermal cracking unit consists of a mixture of the deasphalted oil and the heavy distillate fraction (16) instead of the mixture (22).

The present invention also comprises equipment for carrying out the process according to the invention, substantially as described under process schemes I and II.

The invention will now be explained with reference to the following four examples. Of these, examples 1 and 2 are examples according to the invention. Examples 3 and 4 are outside the scope of the invention and have been included in the application for the sake of comparison. In the examples, an atmospheric distillation residue of a crude mineral oil with an initial boiling point of 350° C. was used as the feed. In the first thermal cracking zone, the temperature was 480° C. and the pressure 5 bar. In the second thermal cracking zone, the temperature was 490° C. and the pressure 20 bar. The desphalting used in examples 1, 2, and 4 was carried out at a temperature of from 130 to 150° C. and a pressure of 40 bar with butane as the solvent and at a butane/oil weight ratio of 2.0. With respect to the composition of the streams (9), (10), and (11) mentioned in the examples, the following can be observed:

Stream (9) consisted of 30 %w of components boiling below 350° C. and of 60 %w of components boiling between 350° and 500° C.

Stream (10) consisted of 60 %w of components boiling above 500° C. and of 35 %w of components boiling between 350° and 500° C.

Stream (11) consisted of 40 %w of components boiling below 350° C.

The deasphalted oil prepared according to example 4 was equal in metal and asphaltenes contents and in Ramsbotum Carbon Residue (RCR) to the mixture of vacuum distillate (18) and deasphalted oil (20) prepared according to example 1.

EXAMPLE 1

This example was carried out according to process scheme I. With 100 pbw of the 350° C.+ atmospheric distillation residue (7) as the starting material, the following quantities of the various streams were obtained:

46 pbw light fraction (9),
54 pbw heavy fraction (10),
6,5 pbw $C_4$- gas stream (13),
10,5 pbw $C_5$-165° C. gasoline fraction (14),
35 pbw 165°-350° C. oil fraction (15),
70 pbw heavy distillate fraction (16),
24 pbw residual fraction (17),
15 pbw vacuum distillate (18),
15 pbw deasphalted oil (20), and
24 pbw bitumen (21).

EXAMPLE 2

This example was carried out according to process scheme II. With 100 pbw of the 350° C.+ atmospheric distillation residue (7) as the starting material, the following quantities of the various streams were obtained:

46 pbw light fraction (9),
54 pbw heavy fraction (10),
7 pbw $C_4$- gas stream (13),
14 pbw $C_5$-165° C. gasoline fraction (14),
42 pbw 165°-350° C. oil fraction (15),
90 pbw heavy distillate fraction (16),
34 pbw residual fraction (17),
27 pbw vacuum distillate (18),
24 pbw deasphalted oil (20), and
37 pbw bitumen (21).

EXAMPLE 3

This example was carried out according to process scheme III. With 100 pbw of the 350° C.+ atmospheric distillation residue (7) as the starting material, the following quantities of the various streams were obtained:

46 pbw light fraction (9),
54 pbw heavy fraction (10),
4 pbw $C_4$- gas stream (13),
7 pbw $C_5$-165° C. gasoline fraction (14),
23 pbw 165°-350° C. oil fraction (15),
51 pbw heavy distillate fraction (16), and
12 pbw residual fraction (17),

EXAMPLE 4

This example was carried out according to process scheme IV. With 100 pbw of the 350° C.+ atmospheric distillation residue (7) as the starting material, the following quantities of the various streams were obtained:

46 pbw light fraction (9),
54 pbw heavy fraction (10),
6 pbw $C_4$- gas stream (13),
10 pbw $C_5$-165° C. gasoline fraction (14),
32 pbw 165°-350° C. oil fraction (15),
66 pbw heavy distillate fraction (16),
22 pbw residual fraction (17),
24 pbw deasphalted oil (20), and
30 pbw bitumen (21).

We claim as our invention:

1. A process for the preparation of gas oil from an asphaltenes-containing hydrocarbon oil by thermal cracking, wherein (a) thermally cracking said asphaltenes-containing oil in a first thermal cracking zone at a temperature from about 400° to 500° C. and a pressure from about 1 to about 30 bar, to obtain a first cracked product comprising 10 to 30 %w on said asphaltenes-containing oil of material boiling at a temperature lower than the boiling range of said asphaltenes-containing oil, (b) separating the product of step (a) by flashing in a phase separation zone into (i) a light fraction boiling substantially below 500° C. which contains in addition to components boiling below 350° C., additional components boiling between 350° and 500° C., and (ii) a heavy fraction boiling substantially above 350° C. which contains in addition to components boiling above 500° C., additional components boiling between 350° and 500° C., (c) separating the heavy fraction from step (b) by fractionation distillation in a vacuum distillation zone into a vacuum distillate fraction and a vacuum residue, (d) deasphalting the vacuum residue from step (c) in a deasphalting zone into a deasphalted oil and bitumen, (e) separating the light fraction from step (b) by fractionation distillation in an atmospheric distillation zone into at least one light distillate fraction, a heavy distillate fraction and an atmospheric residual fraction, (f) passing the vacuum distillate fraction from step (c) and the deasphalted oil from step (d) to step (g), (g) thermally cracking the heavy distillate fraction from step (e) in admixture with components from step (f) in a second thermal cracking zone at a temperature from about 400° to 550° C. and a pressure from about 1 to 30 bar to obtain a second cracked product comprising from 20 to 75 %w of components boiling below the boiling range of said asphaltenes-containing oil feed to step (a), and (h) withdrawing said at least one light distillate fraction from step (e).

2. A process according to claim 1 wherein an atmospheric distillation residue of a crude mineral oil is used as the asphaltenes-containing hydrocarbon oil fuel to step (a).

3. A process according to claim 1 wherein such cracking conditions are used in the first and second thermal cracking units that cracking products are obtained which consist of 10–30 %w and 20–60 %w, respectively, of components boiling below the boiling range of the feed for the first thermal cracking unit.

4. A process according to claim 1 wherein the residual fraction from the atmospheric distillation unit is separated by vacuum distillation into a vacuum distillate and a vacuum residue, and that the vacuum distillate so obtained is used as feed components for the second thermal cracking unit.

5. A process according to claim 1 wherein heavy fraction from step (b) and the residual fraction from step (e) are continuous feed for the second thermal cracking unit step (c).

6. A process according to claim 1 wherein step (d), the deasphalting, is effected by using butane as the solvent.

* * * * *